US009752847B2

(12) United States Patent
Steele

(10) Patent No.: US 9,752,847 B2
(45) Date of Patent: Sep. 5, 2017

(54) SPEED LOADER FOR BLACK POWDER ARMS AND RELATED METHODS

(71) Applicant: Foster Steele, Visalia, CA (US)

(72) Inventor: Foster Steele, Visalia, CA (US)

( * ) Notice: Subject to any disclaimer, the term of this patent is extended or adjusted under 35 U.S.C. 154(b) by 0 days.

(21) Appl. No.: 15/074,850

(22) Filed: Mar. 18, 2016

(65) Prior Publication Data

US 2016/0273872 A1 Sep. 22, 2016

Related U.S. Application Data

(60) Provisional application No. 62/136,395, filed on Mar. 20, 2015, provisional application No. 62/156,227, filed on May 2, 2015.

(51) Int. Cl.
*F41C 9/08* (2006.01)

(52) U.S. Cl.
CPC ..... *F41C 9/085* (2013.01)

(58) Field of Classification Search
CPC ..... F41C 9/08; F41C 9/085
See application file for complete search history.

(56) References Cited

U.S. PATENT DOCUMENTS

| | | | | |
|---|---|---|---|---|
| 3,339,304 | A | 9/1967 | Knode, Jr. et al. | |
| 3,384,989 | A | 5/1968 | Thomas | |
| 3,805,434 | A | 4/1974 | Sudano | |
| 4,137,663 | A | 2/1979 | Farber | |
| 4,232,468 | A | 11/1980 | Chapin | |
| 4,437,249 | A * | 3/1984 | Brown | F41C 9/08 42/51 |
| 4,633,781 | A | 1/1987 | Bergman | |
| 4,648,192 | A | 3/1987 | Harness | |
| 4,735,009 | A | 4/1988 | Jett, Jr. | |
| 5,010,677 | A | 4/1991 | Carron | |
| 5,109,623 | A | 5/1992 | French | |
| 5,133,143 | A * | 7/1992 | Knight | F41C 9/08 42/51 |
| 5,214,238 | A * | 5/1993 | Young | F42B 14/064 102/439 |

(Continued)

FOREIGN PATENT DOCUMENTS

| | | | |
|---|---|---|---|
| DE | 3912253 | A1 | 1/1992 |
| WO | 8403937 | A1 | 10/1984 |

OTHER PUBLICATIONS

Gunadapters.com—12 guage to 9 mm Luger Rifled Black Powder Adapter—viewed as early as Mar. 30, 2015, retrievable at http://www.gunadapters.com/zombie-series-3-inch-rifled/.

(Continued)

*Primary Examiner* — Benjamin P Lee
(74) *Attorney, Agent, or Firm* — Mark D. Miller; William K. Nelson

(57) ABSTRACT

The invention relates to a firearm loading devices that may be inserted into a firearm at or near the proximal end of a barrel of a compatible firearm, as well as firearms operable to receive such loading devices and related methods. In some examples, the loading devices may be packed with propellant and one or more projectiles and inserted into a receiver in a compatible firearm. In other examples, the loading devices will accept bullet cartridges or shells. The loading devices may be used with black-powder firearms, such as muzzle-loading rifles, but are not limited thereto.

30 Claims, 12 Drawing Sheets

(56) References Cited

U.S. PATENT DOCUMENTS

| | | | | |
|---|---|---|---|---|
| 5,363,769 | A | 11/1994 | Bellak | |
| 5,487,232 | A | 1/1996 | Osborne et al. | |
| 5,561,934 | A | 10/1996 | Knight | |
| 5,623,779 | A * | 4/1997 | Rainey, III | F41C 9/08 42/51 |
| 5,729,927 | A | 3/1998 | Shaver, Jr. et al. | |
| 6,311,421 | B1 * | 11/2001 | Knight | F41C 9/08 42/51 |
| 6,385,887 | B1 * | 5/2002 | Johnston | A47G 1/065 40/729 |
| 6,516,549 | B1 * | 2/2003 | Hildebrandt | F41C 9/08 42/51 |
| 6,637,143 | B1 | 10/2003 | Wykle | |
| 6,688,232 | B2 | 2/2004 | Griesbach et al. | |
| 6,865,838 | B2 | 3/2005 | Williams et al. | |
| 7,260,911 | B2 * | 8/2007 | Davis | F41G 3/323 42/116 |
| 7,316,092 | B2 * | 1/2008 | DeLeeuw | F41A 3/58 42/40 |
| 7,353,631 | B2 * | 4/2008 | Calvete Zumalde | F41C 9/08 42/23 |
| 7,526,888 | B1 | 5/2009 | Joyce | |
| 7,726,058 | B2 | 6/2010 | Richards | |
| 7,975,616 | B2 | 7/2011 | Hill | |
| 8,132,511 | B2 | 3/2012 | Epstein et al. | |
| 8,490,308 | B2 | 7/2013 | Schneider | |
| 8,671,607 | B2 | 3/2014 | Laney et al. | |
| 8,677,901 | B2 | 3/2014 | Epstein et al. | |
| 9,146,086 | B2 * | 9/2015 | Peterson | F41A 3/00 |
| 9,329,003 | B2 * | 5/2016 | Peterson | F42B 5/02 |
| 9,459,071 | B2 * | 10/2016 | Hendricks | F42B 5/025 |
| 2002/0035800 | A1 | 3/2002 | Lewis | |
| 2002/0129531 | A1 * | 9/2002 | Camp | F41C 9/08 42/51 |
| 2005/0016050 | A1 * | 1/2005 | Howell | F41C 9/08 42/61 |
| 2005/0183318 | A1 * | 8/2005 | McGivern | F41A 21/00 42/76.01 |
| 2006/0086029 | A1 * | 4/2006 | Kirkpatrick | F41C 9/08 42/51 |
| 2008/0282596 | A1 * | 11/2008 | DeLeeuw | F41A 3/58 42/51 |
| 2009/0265973 | A1 * | 10/2009 | Calvete Zumalde | F41C 9/08 42/51 |
| 2010/0281746 | A1 * | 11/2010 | Anders | F41C 9/085 42/90 |
| 2013/0091752 | A1 | 4/2013 | Ervin | |
| 2014/0090284 | A1 * | 4/2014 | Peterson | F42B 5/38 42/51 |
| 2015/0013202 | A1 * | 1/2015 | Hendricks | F42B 5/025 42/51 |
| 2015/0047245 | A1 | 2/2015 | Ervin | |

OTHER PUBLICATIONS

Gunadapters.com—12 guage to 209 Rifled Black Powder Adapter—viewed as early as Mar. 24, 2015, retrievable at http://www.gunadapters.com/209-muzzle-loading-adapters/.

Thompson Flex Loader—viewed as early as Mar. 20, 2015, retrievable at http://www.cabelas.com/product/Thompson-Center-U-View-Flex-Loader/734699.uts.

De Blenk et al., Double barrelled gun—has second barrel mounted in guide to enable it to expand freely in longitudinal direction, English Abstract of German Patent Publication DE3912253, Jan. 16, 1992, European Patent Organization, http://www.epo.org/searching/free/espacenet.html.

* cited by examiner

SPEED LOADER FOR BLACK POWDER ARMS AND RELATED METHODS

This application is non-provisional application claiming the benefit of U.S. Provisional Application Nos. 62/136,395 (filed on Mar. 20, 2015) and 62/156,227 (filed on May 2, 2015), both of which are incorporated herein by this reference in their entireties.

FIELD OF THE INVENTION

The present invention relates to loading device for firearms and firearms for receiving the same, and more particularly to improved loading devices for black powder arms and black powder firearms that receive the same, and methods of using the same.

BACKGROUND OF THE INVENTION

Black powder, muzzle-loading firearms have recently seen a resurgence in popularity. Muzzle-loading firearms are essentially primitive rifles, shotguns, or pistols, based on designs used during the early days of America and lacking the effective range of more modem center fire rifles and the speed of reloading available to cartridge firearms. Typically, modern muzzle-loaders have a caplock design, although flintlocks are in use, as well. The caplock design includes a hammer that swings into a percussion cap which contains an explosive fulminate of mercury. The percussion cap rests on a nipple through which the spark travels to reach the main charge in the barrel. The most modem type of muzzleloader is an in-line caplock (having a hammer, nipple and cap in-line with the barrel) that provides more effective discharge. For example, break-action muzzle-loading rifles are one popular design, wherein a breech plug is positioned in a breech (breech plug receiver) that is accessible when the firearm is opened at the breech. The breech plug may include a primer cap receiver (e.g., a nipple) and the spark generated by striking the primer cap is carried to a propellant and shot that has been muzzle-loaded in the barrel. The break-action design of such muzzle-loading rifles facilitates an in-line design for a more effective discharge and facilitates easier maintenance (e.g., the breech plug can be removed to allow end to end access to the barrel for cleaning).

During loading of a muzzle-loading firearm, a charge, a sabot or patch (wad), if necessary, and a projectile, in that order, are loaded through the discharging end of the barrel. The contents are typically packed toward the breech end of the firearm using a ramrod to ensure a consistent loading and seating pressure of the propellant and the projectile. Seating reduces the chances of an inadvertent blow up of the barrel of the firearm because of an air gap formed between the propellant and the projectile. The loading process for muzzle-loading firearms is slow and tedious.

Additionally, the imprecision of the loading process can present danger to the user. Because the powder, projectile and percussion cap are separately loaded for each shot and are not subject to mechanical assembly in a cartridge, muzzle-loading firearms are particularly vulnerable to conditions known as hangfire or misfire where the gun does not discharge immediately upon the trigger being pulled. A misfire occurs when the gun does not fire at all. A hangfire occurs when the cap or flint successfully flames and sends sparks toward the main charge, but the main charge does not ignite for a few seconds after the trigger is pulled. A hangfire can be particularly dangerous because the user may position the gun unsafely, thinking the gun has misfired, prior to it discharging.

Due to such problems with muzzle-loading firearms, new loading technologies and methods are needed.

SUMMARY OF THE INVENTION

The present invention provides speed-loading devices for black powder firearms that allow the operator to avoid the tedium and dangers of muzzle-loading the firearms, as well as firearms that are designed to receive the speed-loading devices. In some embodiments, the invention relates to a cylindrical speed-loading device that may be removably inserted into a receiver of a black powder firearm (e.g., the breech of a break-action firearm, the bolt receiver of a bolt-action firearm, or a chamber within cylinder magazine of a revolver firearm). The firearm may be of the muzzle-loading kind, which often include a breech plug against which the muzzle-loaded powder and shot are typically packed prior to firing the weapon. Embodiments of the present invention may be used to replace the breech plug with a speed-loading (a breech-loading) device that may be pre-packed with powder (or black powder pellets) and shot (and optionally other materials such as sabot). In other embodiments, the speed-loading device may replace a bolt in a bolt-action firearm or may be for use in a revolving cylinder of a revolver black powder firearm). The embodiments of the present invention may allow a muzzle-loading firearm to be more efficiently and conveniently loaded at the breech of the gun.

Embodiments of the speed-loading devices of the present invention may have a cylindrical shape that fits into a receiver (e.g., a breech) of a firearm. The device may include a load chamber in a distal end thereof that has an internal diameter (a bore) that may be equal or substantially equal to the bore diameter of the firearm's barrel. The load chamber may be packed with black powder (e.g., loose powder or pellets), a projectile (e.g., a bullet, a ball, pellets, etc.), and optionally a patch, sabot, or other materials that may include with the shot.

In some embodiments, and without limitation, the speed-loading device may also include a primer pocket for receiving a primer (e.g., a 209 primer or other ignition source), and a transfer channel (flash hole) connecting the primer pocket to the load chamber, which may allow the ignition spark to pass from the primer pocket to the load chamber to ignite the powder therein. The primer pocket may include a nipple for loading the primer therein.

The load chamber may have a bore having an interior diameter that is equal or substantially equal to the interior diameter of the barrel of the firearm into which the speed-loading device is inserted. In some embodiments, and without limitation, the load chamber may have an outer wall that is sufficiently thick and/or is made of sufficiently strong material to withstand the pressure created by ignition of black powder (e.g., 50 to 100 grains of black powder) within in the load chamber. In such embodiments, and without limitation, the firearm into which the speed-loading device is inserted may be modified to accommodate the outer diameter of the load chamber. In other embodiments, and without limitation, the speed-loading device may be configured with a thin outer wall that is designed to slip inside the barrel of conventional black powder firearm, such that the difference between the inner diameter of the load chamber and the inner diameter of the barrel of the firearm is insignificant (e.g., less than a millimeter). Additionally, in some implementations, and without limitation, the bore of the load chamber may have rifling that matches or substantially matches the rifling of the barrel of the firearm (e.g., same spiraling pattern).

The exterior structure of the speed-loading device of the present invention may vary depending on the particular firearm for which the speed-loading device will be used. Some embodiments of the invention, and without limitation, may be configured to be inserted into the breech of a break-action firearm. In such embodiments, and without limitation, the exterior of the speed-loading device may have a proximal head portion or knurl that abuts the proximal end of the receiver (e.g., the breech), and a male threading adjacent to the head portion. In some embodiments, and without limitation, there may be a gap between the head portion and the male threading. The male threading may be engaged with female threading within the breech or barrel to secure the speed-loading device in position within the firearm. The exterior of the load chamber may be smooth and fit within the breech. Such embodiments of the speed-loading device may be installed and removed by hand from the breech of the firearm by simply rotating (screwing) the threads of the speed-loading device to engage or disengage the threading in the breech of the firearm. The engagement of the speed-loading device of such embodiments with the breech of a break-action firearm may be both simpler and more efficient than conventional muzzle loading. Additionally, the ease of removing the speed-loading device may allow the gun and the speed-loading device to be cleaned more quickly and efficiently than a conventional muzzle-loaded weapon (which include a breech plug that must be removed with tools).

In some implementations, and without limitation, the male threading on the exterior of the speed-loading device may be relatively short in order to reduce the time required to engage the male threading of the speed-loading device with the complementary (e.g., female) threading within the breech of the firearm. For example, and without limitation, the speed-loading device may include male threading on its exterior requiring about one to about ten 360° rotations (e.g., about one to about five 360° rotations, or any value or range of values therein) to fully engage the speed-loading device with the female threading within the breech of the firearm. The term "fully engage" as used above is intended to indicate that the full length of the male threading on the exterior of the speed-loading device has been engaged with the female threads in the breech of the firearm. In some embodiments, and without limitation, the exterior of the speed-loading device may not include any threading, and may have a smooth exterior from the head portion to the distal end of the load chamber. In such embodiments, the speed-loading device may be efficiently removed from the breech of the break-action firearm without the need to disengage the speed-loading device from threading within the breech. Such embodiments include the same efficiency benefits with regard to loading and cleaning as the threaded embodiments.

In some embodiments, and without limitation, the speed-loading device may be configured to be inserted into a bolt action, black powder firearm. In such embodiments, and without limitation, the speed-loading device would function both as the bolt and a speed-loading device for holding a load ready for firing in the breech at the proximal end of the barrel of the bolt-action firearm. In such embodiments, and without limitation, the exterior of the speed-loading device may be smooth, to allow it to be cleanly and efficiently passed through the bolt receiver when it is inserted into or removed from the receiver. The speed-loading device may include a bolt handle on the exterior thereof (e.g., integrally formed with the speed-loading device or securely attached thereto) for manipulating and moving the bolt within the receiver.

In some embodiments, and without limitation, the load chamber may be separable from the rest of the speed-loading device. For example, and without limitation, the load chamber may be connected by threading or some other coupling mechanism to the proximal portion of the speed-loading device to connect the load chamber to a transfer channel in the proximal portion of the speed-loading device. The load chamber may have an internal dividing wall that divides the proximal portion of the speed-loading device from the load packed in the load chamber, with a hole in the dividing wall that aligns with the transfer channel of the speed-loading device. However, such a dividing wall is optional, and the load may optionally be packed against the proximal end of the speed-loading device when the speed-loading device is assembled. In such embodiments, the load chamber may be replaced on the speed-loading device if the load chamber is damaged by use or other eventualities (e.g., being dropped, etc.). The removal of the load chamber from the speed-loading device may also facilitate cleaning of the transfer channel, the interior of the load chamber, and/or the primer pocket when the speed-loading device is disassembled.

In some embodiments, and without limitation, the speed-loading devices of the present invention may be retrofit designs that may be used in existing muzzle-loading firearms that include a breech for inserting and removing a breech plug. In such embodiments, the male threading on the exterior of the speed-loading device (or breech-loading device) may be relatively short in order to reduce the time required to engage the male threading of the speed-loading device with complementary (e.g., female) threading within the breech of the conventional firearm, even though the female threading in the breech may be designed to receive a breech plug (rather than a speed loading device) and may be considerably longer than the male threading of the speed-loading device. For example, and without limitation, the speed-loading device may include male threading on its exterior requiring about one to about ten 360° rotations (e.g., about three to about five 360° rotations, or any value or other range of values therein) to fully engage the speed-loading device with the female threading within the breech of the firearm. Additionally, in such implementations, and without limitation, the transfer channel may extend past the end of the male threading on the exterior of the speed-loading device, such that the thicker metal wall of the transfer channel position in the threaded area of the breech and the thinner walls of the load chamber are only located within the barrel of the firearm. In such embodiments, the close fit between the wall of the load chamber and the rifle barrel may help to prevent expansion or failure of the wall of the load chamber.

In other embodiments, and without limitation, the speed-loading device may be configured to receive a cartridge load, such as a black powder cartridge, or low velocity cartridge (e.g., a cowboy load), rather than a loose powder or powder pellet load, such that it may convert a black powder firearm to shoot cartridge rounds of a particular caliber. Such embodiments function as a cartridge conversion device, for converting a muzzle-loading firearm into a breech-loading, cartridge firing firearm. Speed-loading devices in such embodiments may include a bore of uniform diameter that passes through the entire speed-loading device (e.g., a bore capable of accommodating a cartridge of a particular caliber). In various implementations, and without limitation, the speed-loading device may have a bore sized for different calibers (e.g., 0.22, 0.32, 0.38, 0.40, 0.44, 0.45, etc.). Such embodiments may allow the black powder firearm to be loaded with cartridges of a particular caliber (e.g., low velocity cartridges, such as cowboy loads). The speed-loading device may include rifling within the bore. The speed-loading device may have a proximal portion that has a diameter that fits closely within the breech of a black powder firearm and a distal portion that extends down the length of the barrel of the firearm and fits closely therein. The proximal portion may be threaded to engage with threading within the bore of the firearm. In some implementations, and without limitation, the bore may be positioned at the center of the speed-loading device, such that the bore is concentric with the barrel of the firearm (e.g., for accommodating center fire cartridges). In some implementations, and without limitation, the bore may be offset from the center of the speed-loading device and located closer to the outer diameter of the speed-loading device (e.g., for accommodating rimfire cartridges).

The embodiments of the present invention also include firearms designed or adapted to receive a speed-loading device as described herein. In some embodiments, and without limitation, a firearm may have a breech receiving section that has a larger inner diameter than the rifle barrel of the firearm in order to receive a speed-loading device having a load chamber with (1) an inner diameter that is the same or substantially the same as the inner diameter of the firearm barrel and (2) an outer diameter that is greater than the inner diameter of the rifle barrel and just slightly smaller than the inner diameter of the breech receiving section, such that the speed-loading device may be inserted into and removed from the breech receiving section while still having a close fit within the breech receiving section. The greater size of the outer diameter of the speed-loading device relative to the inner diameter of the barrel allows for inner diameter of the load chamber to match the inner diameter of the rifle barrel, while still having a substantial thickness in the walls of the load chamber.

In some embodiments, and without limitation, the firearm may be a bolt-action black powder rifle that is adapted to receive a speed-loading bolt that includes a bolt handle and that functions as the bolt and a speed-loading device for holding a load ready for firing in the breech at the proximal end of the barrel. In such embodiments, the firearm would include a bolt receiver for receiving the speed-loading bolt, and bolt handle-receiving slot into which the bolt handle is inserted and locked into place.

In some embodiments, the barrel may have a tapered internal structure at its proximal end for receiving the load chamber to assist in preventing the escape of pressure from the load chamber and barrel through the point at which the load chamber and the barrel meet. The load chamber may also have a tapered outer surface (a male tapered surface) at its distal end that is complementary to the tapered interior of the barrel (a female tapered surface) at the proximal end of the barrel. The tapered structure of the barrel may also aid in preventing the expansion of the load chamber upon ignition of the black powder due to the pressure created in the load chamber. In other embodiments, the distal end of the load chamber may be fitted with an O-ring that creates a tight seal between the load chamber and the proximal end of the barrel to assist in preventing the escape of pressure from the load chamber and barrel through the point at which the load chamber and the barrel meet. In further embodiments, and without limitation, the speed-loading device may include a gasket or O-ring on the exterior of the load chamber such that it is position between the load chamber and the wall of the breech. Such a gasket may be included on the speed-loading device instead of or in addition to a gasket or O-ring on the distal end of the load chamber. The gasket may be positioned anywhere along the exterior of the load chamber (e.g., about ¼ inch to about a 1 inch from the proximal end of the load chamber).

In further embodiments, and without limitation, the firearm may include a firearm that includes a revolving cylinder designed to receive multiple black powder speed-loading devices that have the same or essentially the same design as the speed-loading devices described herein. For example, and without limitation, a firearm according to such embodiments may include a revolving cylinder that includes two to ten parallel chambers (e.g., three to five chambers, or any value therein), each for receiving a speed-loading device as described herein. In such embodiments, and without limitation, the cylinder may be cycled (rotated) between chambers as the hammer of the firearm is pulled back into firing position. Implementations of the revolver may be single action or double action. Such embodiments may allow the operator of the firearm to shoot multiple shots without the need to reload.

In some embodiments, and without limitation, the speed-loading device may be configured such that it can be used with a conventional black powder firearm (the "retrofit" embodiments). In such embodiments, and without limitation, the load chamber of the speed-loading device may have relatively thin, but strong metal walls that can resist expansion under the pressure created by the ignition of the black powder in the load chamber. In such embodiments, and without limitation, the outer diameter of the load chamber may be just slightly smaller than the inner diameter of the rifle barrel, such that the load chamber may be inserted into and removed from the rifle barrel while still having a close fit within the rifle barrel. Also, wall of the load chamber is very thin such that the inner diameter of the load chamber is substantially the same as or only slightly less than the inner diameter of the rifle barrel (e.g., the inner diameter of the rifle barrel less the diameter of the load chamber wall). In some implementations, and without limitation, the thickness of the wall of the load chamber may be in a range of about 0.05 mm in thickness to about 1 mm (e.g., about 0.1 mm to about 0.5 mm, or any value or other range of values therein). In such embodiments, the wall of the load chamber may be made from a strong and rigid metal that is able to maintain its shape and diameter when exposed to the pressure created by the ignition of a black powder load packed therein. For example, the load chamber may be made from various metal alloys such as steels, high-strength aluminum alloys, etc. Without limiting the invention, some specific examples of materials that may be used to form the load chamber wall include stainless steel, such as type 17-4 alloy and the 400 series alloys, particularly type 416; chrome molybdenum steel such as types 4140, 4150, and 4340; high-strength aluminum alloys such as types 6061 and 7075; etc.

The embodiments of the present invention provide advantages over conventional black powder and muzzle-loading firearms, including more efficient reloading of the firearm. The breech-loading devices of the present invention may be quickly withdrawn from the breech of a break-action or bolt-action firearm and replaced with a second pre-loaded speed-loading device (e.g., the operator may carry multiple pre-loaded speed-loading devices for ease and efficiency of reloading). Additionally, the ease of removal of the speed-loading device may facilitate more efficient cleaning of the firearm.

The present invention also provides improved safety of the firearms. For example, the speed-loading device can be quickly removed for inspection of the firearm by a game warden or ranger, who generally requires the gun to be unloaded prior to inspection. Also, if the gun misfires, the speed-loading device allows the unfired round to be removed quickly from the breech of the gun rather than through the barrel.

It should be understood that modifications to a conventional black powder muzzle-loading firearm or a new firearm design may be necessary in order to accommodate the shapes of some of the embodiments of the speed-loading devices speed-loading device of the present invention, but not for all embodiments. It should be further understood that the scope of the present invention includes new firearm designs (e.g., break-action, bolt-action, revolver, etc.) that are configured to accept a speed-loading device speed-loading device according to embodiments of the present invention.

It should be further understood that the embodiments of the speed-loading devices speed-loading device of the present invention may be adapted for use in black powder firearms of any caliber.

In some embodiments, and without limitation, the present invention relates to a breech loading device that includes a cylindrical body having a distal end and a proximal end, where the distal end may be inserted into a firearm in alignment with a barrel of the firearm; a load chamber in the distal end of the breech-loading device having a bore therein of a diameter that may be substantially the same as a barrel bore of the barrel of the firearm; and a channel connecting the load chamber and the proximal end of the device, wherein the channel may be operable to transmit a spark generated from a primer ignited by the firing operation of the firearm. In such embodiments, the breach loading may be operable to be inserted into the breech of a break-action, muzzle-loading firearm. The breach loading device may also include a primer pocket at the proximal end of the device, where the channel connects the primer pocket with the load chamber allowing a spark generated by a firing hammer of the firearm striking a primer cap positioned in the primer pocket to travel to the load chamber and ignite gun powder positioned in the load chamber. The breach loading device may also include threading on the exterior thereof for engaging with threading within the breech of the firearm. The breach loading device may also include a head portion on the proximal end of the cylindrical body for abutting a proximal end of the breech of the firearm. The exterior surface of the cylindrical body of the breach loading device may be smooth to prevent obstruction of the device as it is inserted and removed from the breech of the firearm. The load chamber of the breach loading device may be detachable from the proximal end of the device. In some examples, the breach loading device may be operable to be inserted into the bolt receiver of a bolt-action black powder firearm. In such examples, the breach loading device may include a bolt handle on the proximal end of the cylindrical body for manipulating the device within the bolt receiver and for engaging a bolt handle slot of the firearm.

In some embodiments, and without limitation, the present invention relates to a speed-loading device that includes a cylindrical body having a distal end and a proximal end, where the distal end may be operable to be inserted into a receiver in a firearm; and a bore in the cylindrical body, the bore having a uniform diameter that has substantially the same diameter as a bore of a barrel of the firearm. In some examples, the firearm may be a break-action firearm, and the receiver may be a cavity at the breech of the firearm proximal to the barrel and the speed-loading device may be operable to be inserted into the receiver of the break-action firearm. In such examples, the cavity may be aligned with the barrel and the speed-loading device may be inserted into the receiver in alignment with a barrel of the firearm. In other examples, the firearm may be a bolt-action firearm, and the receiver may be a bolt receiver of the firearm proximal to the barrel and the device may be operable to be inserted into the bolt receiver. In such examples, the speed-loading device may further include a bolt handle on the proximal end of the cylindrical body for manipulating the device within the bolt receiver and for engaging a bolt handle slot of the firearm. In some examples, the speed-loading device may include threading on the exterior thereof for engaging with threading within the breech of the firearm. In other examples, the exterior surface of the cylindrical body may be smooth to prevent obstruction of the device as it is inserted and removed from the breech of the firearm. The speed-loading device may further include a head portion on the proximal end of the cylindrical body for abutting a proximal end of the breech of the firearm. The load chamber of the speed-loading device may be detachable from the proximal end of the device.

In some embodiments, and without limitation, the present invention relates to a firearm that includes a receiver for receiving a speed-loading device, the speed-loading device including a cylindrical body having a distal end and a proximal end, where the distal end may be operable to be inserted into a receiver in the firearm, and a bore in the cylindrical body, the bore having a uniform diameter that has substantially the same diameter as a bore of a barrel of the firearm. In some embodiments, the firearm may include a revolving cylinder magazine, the receiver being one of a plurality of chambers in the revolving cylinder, each operable to receive a speed-loading device. In some embodiments, the firearm may be a break-action firearm, and the receiver may be a cavity at the breech of the break-action firearm proximal to the barrel and the speed-loading device may be operable to be inserted into the receiver of the break-action firearm. In such embodiments, the cavity may be aligned with the barrel and the speed-loading device may be operable to be inserted into the receiver in alignment with a barrel of the firearm. In some embodiments, the firearm may be a bolt-action firearm, and the receiver may be a bolt receiver of the bolt-action firearm proximal to the barrel and the speed-loading device may be operable to be inserted into the bolt receiver. In such embodiments, the speed-loading device may include a bolt handle on the proximal end of the cylindrical body for manipulating the speed-loading device within the bolt receiver and for engaging a bolt handle slot of the bolt-action firearm. In some examples, the speed-loading device may include threading on the exterior thereof for engaging with threading within the receiver of the firearm. In other examples, the exterior surface of the cylindrical body may be smooth to prevent obstruction of the device as it is inserted and removed from the receiver of the firearm. In some examples, the speed-loading device may include a head portion on the proximal end of the cylindrical body for abutting a proximal end of the receiver of the firearm.

In some embodiments, and without limitation, the present invention relates to a firearm that includes a revolving cylinder magazine, the magazine having a plurality of chambers therein, each for receiving a speed-loading device; where the speed-loading device includes a cylindrical body having a proximal end and a distal end that may be operable to be inserted into one of the plurality of chambers, and a bore in the cylindrical body, the bore having a uniform diameter that has substantially the same diameter as a barrel bore of a barrel of the firearm. The firearm may include a cycling mechanism for rotating the magazine to position one of the plurality of chambers in alignment with the barrel. Cycling the magazine may position the bore of a speed-loading device in alignment with the barrel bore when the chamber in which the speed-loading device is inserted is aligned with the barrel. In some examples, the bore of each of the chambers may be threaded for engagement with threading on an exterior surface of the speed-loading device. The magazine of the firearm may be removable for cleaning and reloading. The magazine may be pivotally attached to the firearm such that it can be rotated on the pivotal attachment to expose the chambers (e.g., one by one) so that each chamber can be reloaded without completely removing and detaching the magazine from the firearm. In some examples, the firearm may having break-top action, allowing the chambers to be exposed and reloading without the removing the magazine from the firearm. In some examples, the firearm may include a magazine-loading gate that allows the chambers to be exposed and reloaded without the need to remove the magazine from the firearm. In some examples, the speed-loading device may include threading on the exterior thereof for engaging with threading within the receiver of the firearm. In other examples, the exterior surface of the cylindrical body may be smooth to prevent obstruction of the device as it is inserted and removed from the receiver of the firearm.

In some embodiments, and without limitation, the present invention relates to a breech loading device that includes a cylindrical body having a distal end and a proximal end, wherein the distal end may be inserted into the barrel of a firearm and the proximal end may engage with the breech of the firearm; and a bore of uniform diameter through the length of the device, wherein the diameter of the bore corresponds to a predetermined firearm cartridge caliber, where the breech-loading device may be operable to convert a black-powder firearm to fire metal case cartridges. In some examples, the bore of the breech-loading device may be concentric with the cylindrical body of the device. In other examples, the bore of the breech-loading device may be offset from and parallel to the central axis of the cylindrical body of the device. The breech-loading device may include a head portion on the proximal end of the cylindrical body for abutting a proximal end of the breech of the firearm. In some examples, the breech-loading device may include threading on the exterior thereof for engaging with threading within the receiver of the firearm. In other examples, the exterior surface of the cylindrical body may be smooth to prevent obstruction of the device as it is inserted and removed from the receiver of the firearm.

In some embodiments, and without limitation, the present invention relates to a method of loading a firearm that includes packing propellant and a projectile into a speed-loading device that includes a cylindrical body having a distal end and a proximal end, where the distal end may be operable to be inserted into a receiver in a firearm, a bore in the cylindrical body, the bore having a uniform diameter that has substantially the same diameter as a barrel bore of a barrel of the firearm, and a load chamber in which the propellant and the projectile are packed; and inserting the speed-loading device into the receiver in the firearm. The speed-loading device may also include a channel connecting the load chamber and the proximal end of the device, wherein the channel may be operable to transmit a spark generated from a primer ignited by the firing operation of the firearm. The speed-loading device may also include a primer pocket at the proximal end of the device, wherein the channel connects the primer pocket with the load chamber allowing a spark generated by a firing hammer of the firearm striking a primer positioned in the primer pocket to travel to the load chamber and ignite gun powder positioned in the load chamber. The method may include positioning a primer cap on the primer pocket. The method may include threading the speed-loading device into the receiver, wherein the speed-loading device includes threading on an exterior thereof for engaging with complementary threading within the receiver of the firearm. In some implementations, the speed-loading device includes a head portion on the proximal end of the cylindrical body for abutting a proximal end of the breech of the firearm. In some implementations, the firearm may be a break-action firearm, and the receiver may be a cavity at the breech of the break-action firearm proximal to the barrel and the speed-loading device is inserted into the receiver of the break-action firearm. In some implementations, the firearm may be a bolt-action firearm, and the receiver may be a bolt receiver of the bolt-action firearm proximal to the barrel and the speed-loading device is inserted into the bolt receiver. In such implementations, the speed-loading device may include a bolt handle on the proximal end of the cylindrical body for manipulating the speed-loading device within the bolt receiver, and the bolt-action firearm includes a bolt handle slot for receiving the bolt handle. In such implementations, the method may include engaging the bolt handle with the bolt handle slot. In some implementations, the firearm may include a revolving cylinder magazine, the receiver being one of a plurality of chambers in the revolving cylinder, each operable to receive a speed-loading device. In such implementations, the method may include packing propellant and a projectile into a plurality of speed-loading devices, and inserting one of the plurality of speed-loading devices into each of the plurality of chambers. In such implementations, the method may include rotating the magazine to cycle between chambers and position one of the plurality of chambers in alignment with the barrel.

Additional aspects and objects of the invention will be apparent from the detailed descriptions and the claims herein.

DESCRIPTION OF THE DRAWINGS

Figure 1:
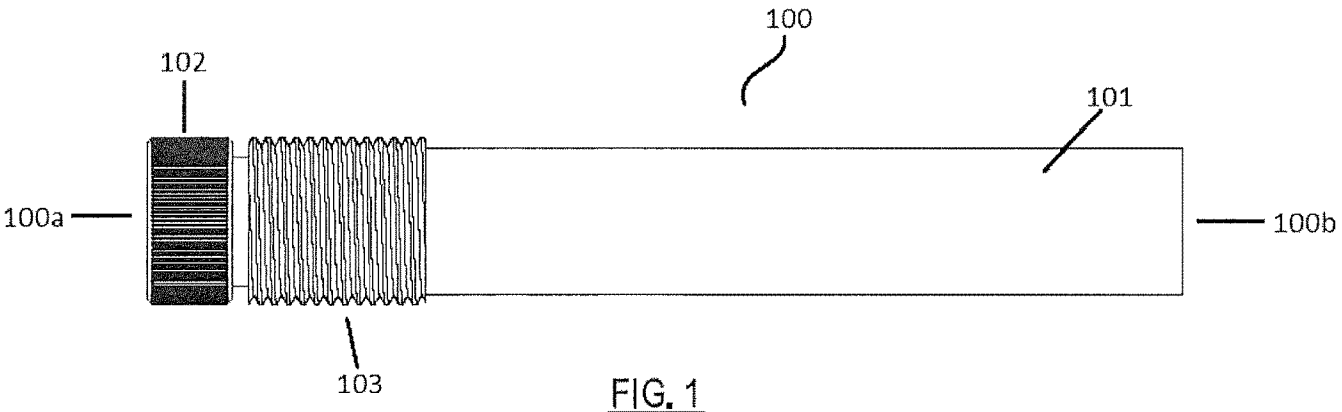
FIG. 1 provides a side view of a speed-loading device according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention as defined by the claims. In the following disclosure, specific details are given to provide a thorough understanding of the invention. However, it will be apparent to one skilled in the art that the present invention may be practiced without these specific details.

Referring to the drawings wherein like reference characters designate like or corresponding parts throughout the several views, and referring particularly to FIGS. 1-13, it is seen that the present invention includes various embodiments of speed-loading devices for muzzle-loading and other black powder firearms, as well as compatible firearms and related methods.

FIG. 1 shows a side view of a speed-loading device according to an embodiment of the present invention. The speed-loading device 100 has a distal end 100*b*, which may be inserted into a receiver of a black powder firearm (e.g., a muzzle-loading firearm), and a proximal end 100*a* which meets the proximal end of the receiver of the black powder firearm, when the speed-loading device is inserted into the receiver. The speed-loading device includes a distal load chamber 101 that may be packed with powder (e.g., loose black powder or pellets) and a bullet, and optionally a sabot or patch and/or other materials that may be included with the load. The load chamber 101 may be packed with a load prior to the speed-loading device being inserted into the receiver of the firearm. The proximal end of the breech-loading device 100 may include a head portion or knurl 102 and a threaded portion 103. The head portion 102 may abut the proximal end of the receiver of the firearm when the speed-loading device 100 is fully inserted into the receiver. The threaded portion 103 may be engaged with complementary (e.g., female) threading within the breech of the firearm to securely engage the speed-loading device 100.

The speed-loading devices disclosed and described in the present application are generally compatible with various black powder firearms, which include various muzzle-loading firearms. For example, some black powder, muzzle-loading firearms are break-action firearms that include a breech near firing mechanism of the firearm. Such firearms typically include a breech plug receiver (e.g., a threaded portion at the proximal end of the firearm's barrel) into which a breech plug is typically installed. Embodiments of the speed-loading devices (e.g., breech-loading devices) of the present invention are operable to be inserted into the breech plug receiver or breech of such break-action firearms in substitution for the breech plug. The use of the speed-loading devices eliminates the need to muzzle-load such firearms, which is tedious and creates various hazards as discussed herein. However, the speed-loading devices of the present invention are not limited to use in break-action black powder firearms. Embodiments of the present invention are operable to be used in bolt-action firearms (e.g., black-powder bolt-action firearms), revolving cylinder magazine firearms (e.g., a revolver firearm), and other firearm designs. In such other firearm designs, the receiver for the speed-loading device may be a bolt receiver (e.g., in a bolt-action firearm), a chamber in a cylinder magazine (e.g., in a revolver firearm), or other appropriate receiver in other firearm designs.

Certain embodiments of the speed-loading devices of the present invention may include various specialized features and alterations that are for adaptation to a particular firearm design. Such variations are exemplary and do limit the present invention, but rather broaden the scope of the embodiments of the speed-loading device of the present invention. In some implementations, and without limitation, the distal end of the load chamber of the speed-loading device may have a narrowing, tapered end on the outer surface thereof (a male tapered end, not shown) that is complementary to a tapered receiving port or recess at the proximal end of the barrel of the firearm into which the speed-loading device is to be inserted (a female tapered recess, not shown). The insertion of the tapered end of the load chamber into the tapered recess in the firearm may create a tight seal between the load chamber and the firearm that may prevent the escape of pressure from the ignition of black powder loaded in the load chamber between the load chamber and the barrel. In other implementations, and without limitation, the end of the load chamber may be fitted with an O-ring that is positioned between the distal end of the load chamber and the barrel of the firearm. In further implementations, and without limitation, the speed-loading device may include an O-ring on the exterior of the load chamber such that it is position between the load chamber and the wall of the breech. The tapered structure of the load chamber and the addition of one or more O-rings may be included in other embodiments of the speed-loading devices disclosed herein, as well.

Figure 2:
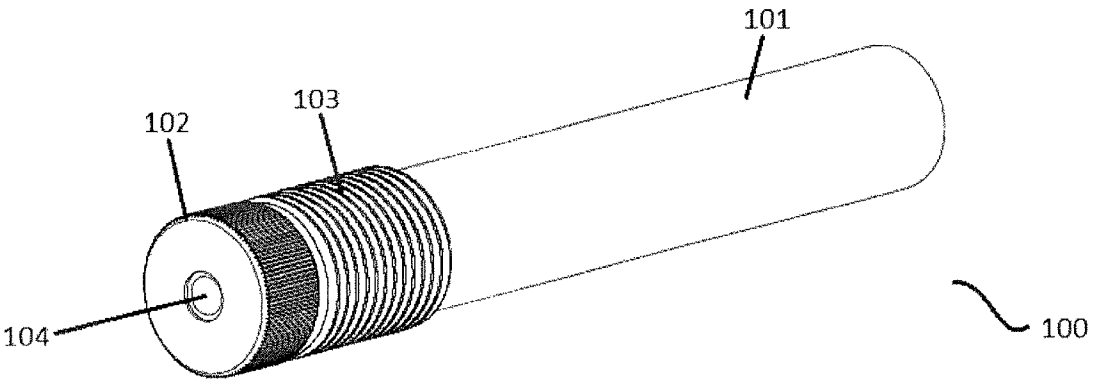
FIG. 2 provides a proximal perspective view of a speed-loading device according to an embodiment of the present invention.

FIG. 2 is a perspective proximal-end view of the speed-loading device 100. In this view, a primer pocket 104 can be seen. A primer cap (e.g., a 209 primer) may be inserted into the primer pocket 104 as an ignition source. The primer pocket 104 may have a nipple therein for receiving a primer cap. The primer pocket 104 may be designed such that it can receive ignition sources other than or in addition to primer caps. The primer pocket may be in communication with the interior of the load chamber 101 through a transfer channel (see, e.g., FIG. 4).

Figure 3:
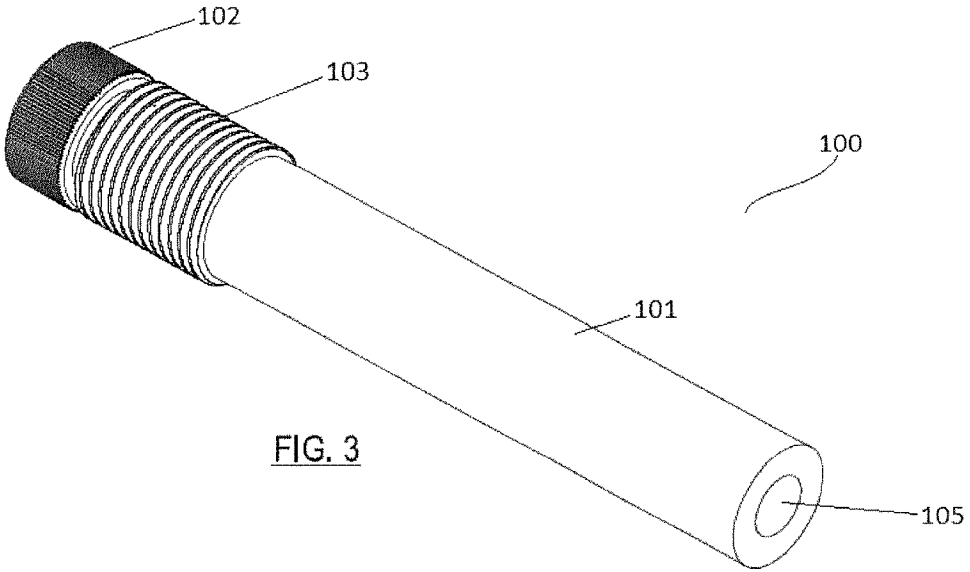
FIG. 3 provides a distal perspective view of a speed-loading device according to an embodiment of the present invention.

FIG. 3 provides a perspective distal-end view of the speed-loading device 100. In this view, a bore 105 of the load chamber 101 can be seen. A load, including powder (e.g., loose black powder or pellets) and a bullet, and optionally a sabot or patch and/or other materials, may be loaded into the bore 105 prior to the insertion of the speed-loading device into the receiver (e.g., the breech) of a firearm. The bore 105 may have an inner diameter that is equal to or substantially equal to the diameter of the bore of the barrel of the firearm into which the speed-loading device is inserted. In other embodiments, and without limitation, the load chamber may have thin wall (e.g., having a diameter in the range of about 0.05 mm to about 1.0 mm, or any value or range therein) and may be partially inserted into the barrel, such that the inner diameter of the bore of the load chamber is only slightly smaller than the inner diameter of the barrel (see, e.g., FIGS. 8*a*-8*d*).

Figure 4:
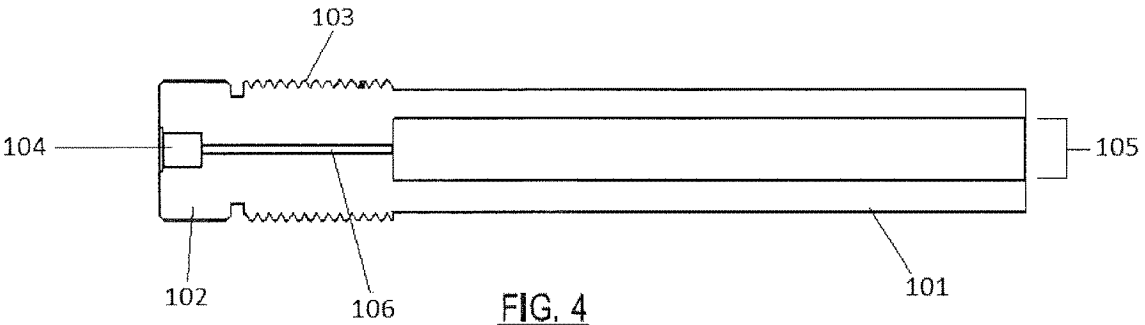
FIG. 4 provides a cross-sectional view of a speed-loading device according to an embodiment of the present invention.

FIG. 4 is a longitudinal cross-sectional view of the speed-loading device 100. In this view, the internal structures of the speed-loading device 100 can be seen, including the interior of the primer pocket 104, the transfer channel 106, and the interior of the load chamber 101. The primer pocket 104 may be connected to the load chamber 101 by the transfer channel 106, such that a spark from the primer pocket 104 that is generated when the firearm is fired (e.g., a spark generated by a firing hammer of the firearm striking a primer cap positioned in the primer pocket) passes through the transfer channel 106 and into the load chamber 101 to ignite the black powder loaded therein. No nipple for receiving a primer cap is shown in FIG. 4, but a nipple may be included in some examples of a speed-loading device of the present invention.

Figure 5:
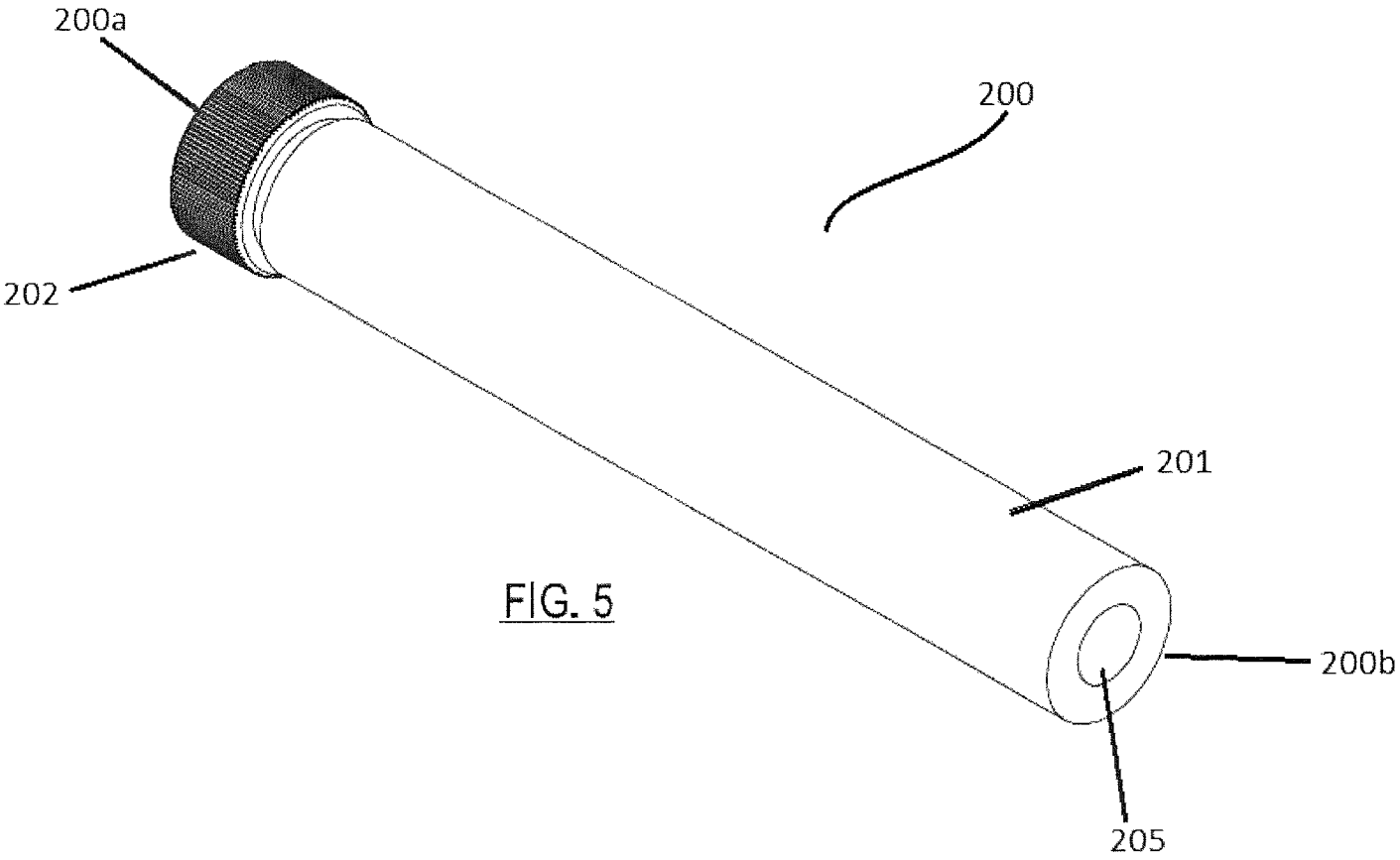
FIG. 5 provides a distal perspective view of a speed-loading device according to an embodiment of the present invention.

FIG. 5 shows a side view of a speed-loading device according to another embodiment of the present invention. The speed-loading device 200 has a distal end 200*b*, which may be inserted into a receiver black powder firearm (e.g., the breech of a break-action black powder firearm, a chamber in a revolving cylinder magazine of a revolver, etc.), and a proximal end 200*a* which meets the proximal end of the receiver of the firearm (e.g., the proximal end of the breech of a break-action black powder firearm), when the speed-loading device is inserted into the breech. The speed-loading device includes a distal load chamber 201 that may be packed with powder (e.g., loose black powder or pellets) and a bullet, and optionally a sabot or patch and/or other materials that may be included with the load. The proximal end of the speed-loading device 200 may include a head portion or knurl 102, but does not include any external threading. The head portion 102 may abut the proximal end of the receiver of the firearm when the speed-loading device 100 is fully inserted into the receiver. The absence of external threading may allow the speed-loading device 200 to be inserted and removed from the breech of a black powder firearm more quickly, making loading of the weapon more efficient.

Figure 6:
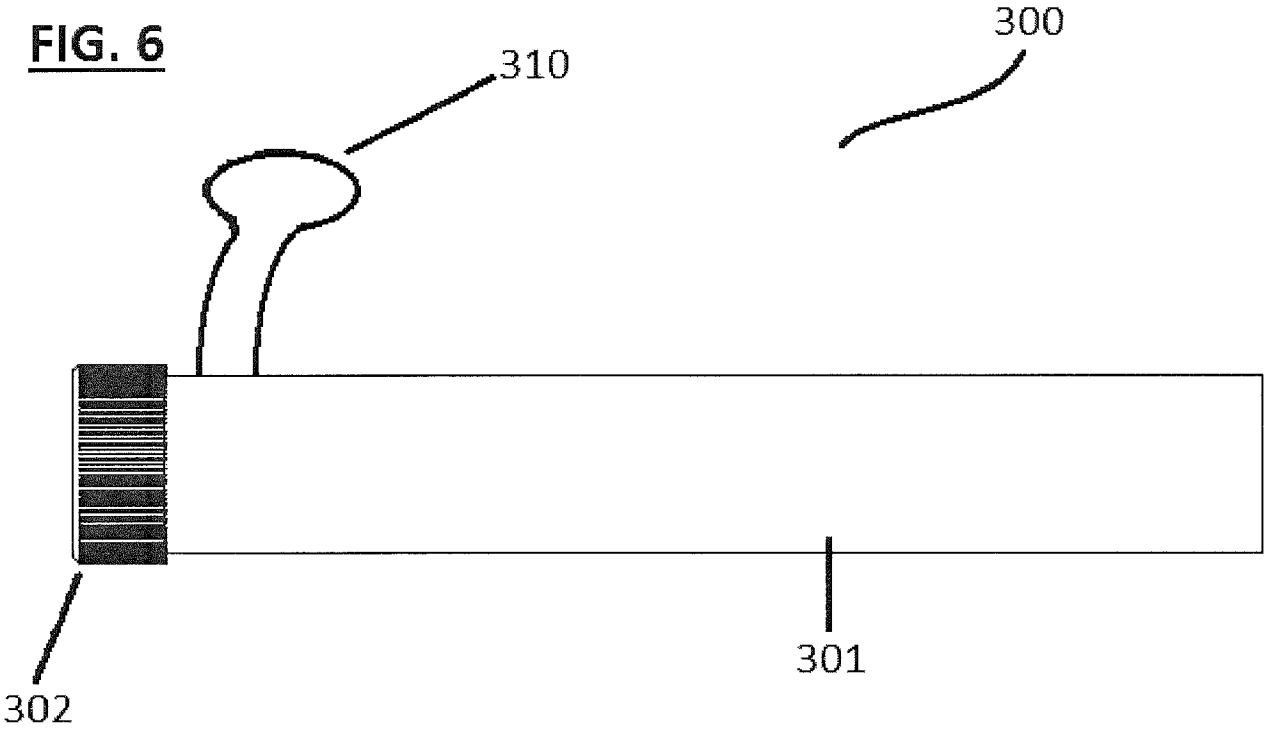
FIG. 6 provides a side view of a speed-loading device according to an embodiment of the present invention.

FIG. 6 shows a side view of a speed-loading device according to an embodiment of the present invention. The speed-loading device 300 is operable for use with a bolt-action black powder firearm. The speed-loading device 300 has a distal end 300*b*, which may be inserted into the bolt receiver of a bolt-action black powder firearm, and a proximal end 300*a* which meets the proximal end of the bolt receiver when the speed-loading device is inserted into the bolt receiver. The speed-loading device 300 includes a distal load chamber 301 that may be packed with powder (e.g., loose black powder or pellets) and a bullet, and optionally a sabot or patch and/or other materials that may be included with the load. The load chamber 301 may be packed with a load prior to the speed-loading device being inserted into the bolt receiver of a firearm. The proximal end of the speed-loading device 300 may include a head portion or knurl 302 that engages with the proximal end of the bolt receiver of the firearm, and a bolt arm 310 for manipulating the position and movement of the speed-loading device 300 in the bolt receiver of the firearm.

Figure 7:
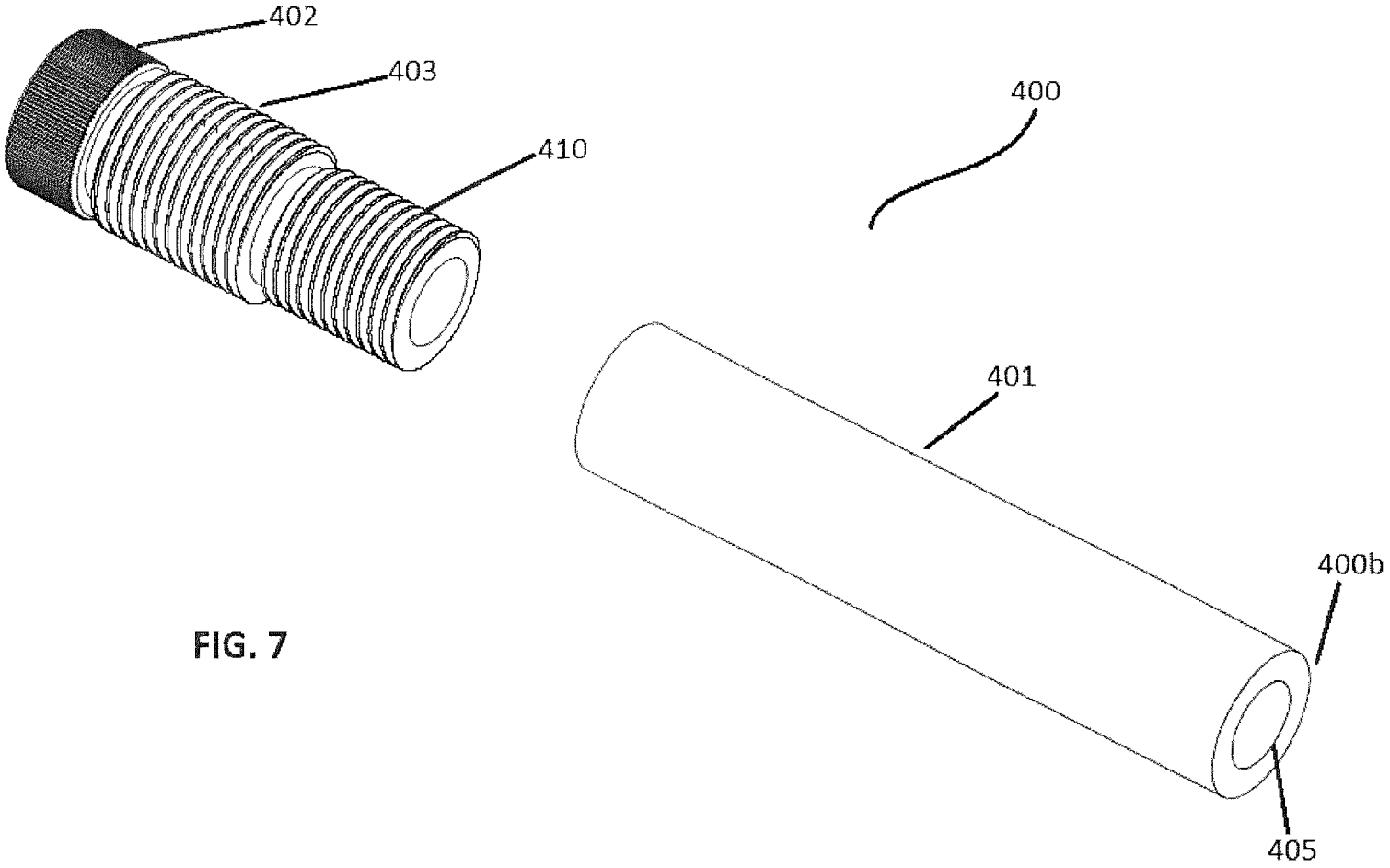
FIG. 7 provides a distal perspective view of a speed-loading device according to an embodiment of the present invention.

FIG. 7 shows a side view of a speed-loading device according to another embodiment of the present invention. The speed-loading device 400 may have two separate portions that may be coupled together by threading or some other coupling method. As shown in FIG. 7, the speed-loading device has a distal end 400*b*, which may be inserted into a receiver of a black powder firearm, and a proximal end 400*a* which meets the proximal end of the receiver of the black powder firearm, when the speed-loading device is inserted into the receiver. The speed-loading device includes a distal load chamber 401 that may be packed with powder (e.g., loose black powder or pellets) and a bullet, and optionally a sabot or patch and/or other materials that may be included with the load. The load chamber 401 may be packed with a load prior to the speed-loading device being inserted into the receiver of the firearm. The proximal end of the speed-loading device 400 may include a head portion or knurl 402 and a threaded portion 403. The load chamber 401 may be attached to the proximal portion of the speed-loading device 400 by engaging the male threading 410 on the proximal portion of the speed-loading device 400 with female threading within the proximal end of the load chamber 401. The load chamber may have an internal dividing wall that divides the proximal threaded portion from the load packed in the chamber, where the dividing wall includes a central hole that is positioned to meet the transfer channel and allow the passage of the primer spark to the black powder in the load chamber. However, such a dividing wall is optional, and the load may optionally be packed against the distal end of the threaded portion 410 when the speed-loading device 400 is assembled. The separable construction of the speed-loading device 400 may provide advantages in that it may easier to clean the load chamber, the transfer channel, and/or the primer pocket when the speed-loading device 400 is disassembled. Also, if the load chamber 401 is damaged, it may be replaced without having to replace the entire speed-loading device. The separable load chamber feature may be may be included in other embodiments of the speed-loading devices disclosed herein, as well.

The present invention includes embodiments of the speed-loading device that may be used with conventional black powder firearms without the need for any modifications to the firearm. In such embodiments, the load chamber may be made with a thin metal wall such that the load chamber may be slipped into the barrel of the firearm. In such embodiments, the load chamber of the speed-loading device may have relatively thin metal wall that can resist expansion under the pressure created by the ignition of the black powder in the load chamber. In such embodiments, and without limitation, the outer diameter of the load chamber may be just slightly smaller than the inner diameter of the barrel of the firearm, such that the load chamber may be inserted into and removed from the barrel while still having a close fit within the barrel. Also, wall of the load chamber is very thin such that the inner diameter of the load chamber is only slightly less than the inner diameter of the barrel (e.g., the inner diameter of the barrel less the diameter of the load chamber wall). In some implementations, and without limitation, the thickness of the wall of the load chamber may be in a range of about 0.05 mm in thickness to about 1 mm (e.g., about 0.05 mm to about 0.5 mm, or any value or other range of values therein). In some implementations, and without limitation, the wall of the load chamber may be made from typical materials used for bullet casings (e.g., brass, steel, aluminum, etc.). In some implementations, and without limitation, a strong, rigid metal may be used to reduce the possibility of deformation of the load chamber wall when exposed to the pressure created by the ignition of a black powder load packed therein. For example, the load chamber may be made from various metal alloys such as steels, high-strength aluminum alloys, etc. (e.g., stainless steel, such as type 17-4 alloy and the 400 series alloys, particularly type 416; chrome molybdenum steel such as types 4140, 4150, and 4340; high-strength aluminum alloys such as types 6061 and 7075; etc.).

Figure 8A:
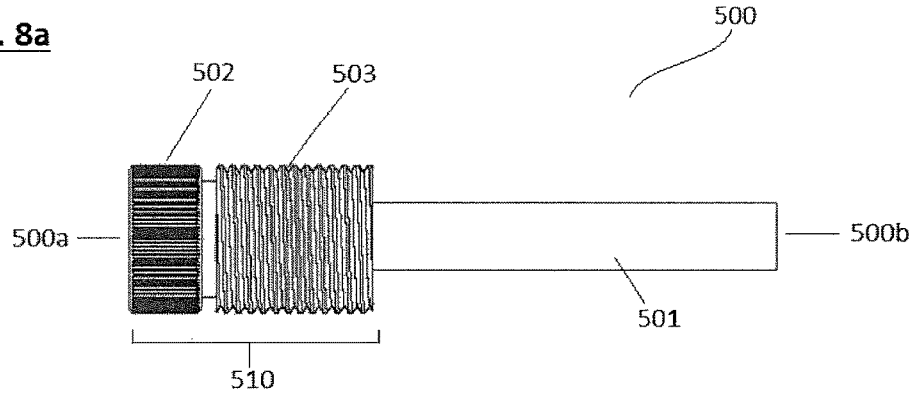
FIG. 8*a* provides a side view of a speed-loading device according to an embodiment of the present invention.
Figure 8B:
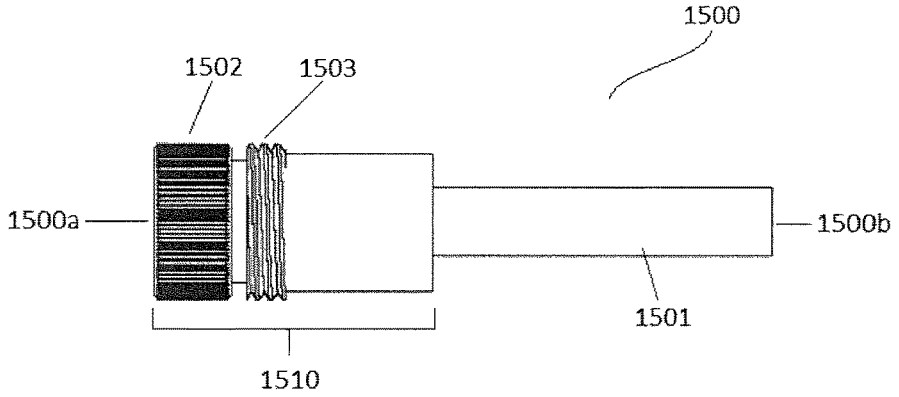
FIG. 8*b* provides a side view of a speed-loading device according to an embodiment of the present invention.

FIGS. 8*a* and 8*b* show exemplary speed-loading devices having load chambers that are sized to fit within the barrel of a conventional black powder firearm. As can be seen from the drawings both speed-loading devices 500 and 1500 include a proximal portion (510 and 1510, respectively) that are sized to fit within the breech of a conventional break-action black powder firearm. These proximal portions 510 and 1510 may have the same length, diameter, and head-design (502 and 1502, respectively) as a conventional breech plug, such that the proximal portions 510 and 1510 can fit neatly into the breech of a conventional break-action black powder firearm. The distal end (500*b* or 1500*b*) may be inserted into the barrel of the firearm through the breech and the speed-loading device may be advanced into the breech until the threading (503 or 1503) engages with the female threading within the breech of the firearm. The speed-loading device may then be rotated to thread into the breech and fix the speed-loading device into the firearm with the load chamber positioned in the barrel of the firearm.

As shown in FIG. 8*b*, the male threading 1503 on the exterior of the speed-loading device 1500 may be relatively short in order to reduce the time required to engage the male threading of the speed-loading device 1500 with the complementary (e.g., female) threading within the breech of the conventional firearm, even though the threading in a breech may be designed to receive a breech plug (rather than a speed-loading device) and be considerably longer than the male threading 1503 of the speed-loading device 1500. The speed-loading device may include male threading on its exterior requiring about 180° rotation to about ten 360° rotations (e.g., about one to about five 360° rotations, or any value or other range of values therein) to fully engage the speed-loading device with the threading within the breech of a firearm. For example, and without limitation, the male threading 1503 shown in FIG. 8*b* has three 360°. Additionally, in such implementations, and without limitation, the transfer channel may extend past the end of the male threading on the exterior of the speed-loading device and past the end of the female threading within the breech of the firearm, such that the thicker metal wall of the transfer channel is positioned in the threaded area of the breech and the thinner walls of the load chamber are only located within the barrel of the firearm. In such embodiments, the close fit between the wall of the load chamber and the rifle barrel may help to prevent expansion or failure of the wall of the load chamber. For example, FIG. 8*b* shows and extended smooth-walled large diameter section 1503*a* that may sit within the distal end of the breech of a conventional black powder firearm, when the speed-loading device 1500 is inserted into the firearm.

Figure 8C:
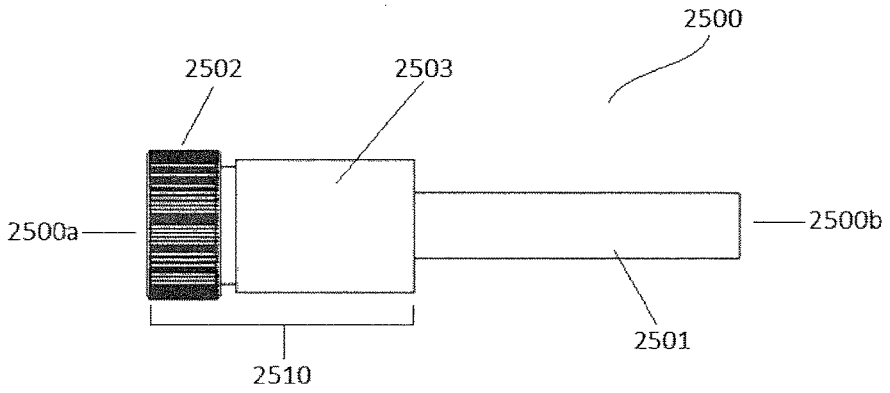
FIG. 8*c* provides a side view of a speed-loading device according to an embodiment of the present invention.

Without limiting the invention, FIG. 8*c* shows a further version of a speed-loading device for insertion in a conventional black powder firearm. The speed-loading device 2500 is similar in construction to the above described speed-loading devices 500 and 1500, though speed-loading device 2500 does not include any threading on the proximal end 2510 of the speed-loading device. The absence of external threading may allow the speed-loading device 2500 to be inserted and removed from the breech or receiver of a black powder firearm more quickly, making loading of the weapon more efficient.

In some implementations, and without limitation, the embodiments of the speed-loading devices for use in conventional black powder firearms ("retrofit embodiments") may have separable load chambers. Similar to the example shown in FIG. 6, the thinner-walled load chambers of the retrofit embodiments may be removably attached (e.g., by threading) to the proximal section of the speed-loading device. In such implementations, and without limitation, the load chamber may have an internal dividing wall that divides the proximal portion of the speed-loading device from the load packed in the chamber, where the dividing wall includes a central hole that is positioned to meet the transfer channel and allow the passage of the primer spark to the black powder in the load chamber. The dividing wall may also provide some reinforcement to the back wall of the load chamber to aid in preventing the proximal end of the load chamber from deforming during discharge of the firearm. However, such a dividing wall is optional, and the load may optionally be packed against the distal end of the proximal portion of the speed-loading device. The separable construction of the speed-loading device may provide advantages in that it may easier to clean the load chamber, the transfer channel, and/or the primer pocket when the speed-loading device is disassembled. Also, if the load chamber is damaged, it may be replaced without having to replace the entire speed-loading device.

Figure 8D:
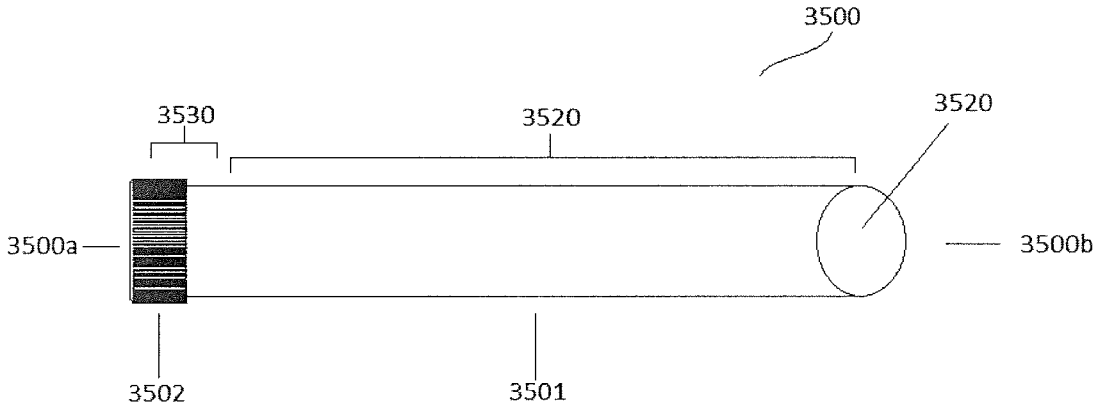
FIG. 8*d* provides a side view of a speed-loading device according to an embodiment of the present invention.

In some embodiments of the present invention, and without limitation, the speed-loading device may be configured for a gun designed to receive a speed-loading device (rather than a conventional firearm). In such embodiments, the speed-loader need not accommodate the breech design or bolt receiver design of a conventional firearm. For example, and without limitation, FIG. 8*d* shows a speed-loading device 3500 that includes a head portion 3502 at its proximal end 3500*a* and a cylindrical body 3501 that has uniform diameter along its entire length. The load chamber 3520 may occupy nearly all of the length of the cylindrical body 2501, and there may be a short transfer channel 3530 near the head portion 3502. The speed-loading device 3500 may be positioned directly into the barrel at the breech of a break-action firearm or into a chamber of a revolving cylinder magazine of a revolver firearm such that the entire length or substantially all of the length of the body 3501 is positioned within the barrel or chamber. In such examples, the strong walls of the barrel or chamber reinforce the wall of the body 3501 against pressure created by the ignition of the black powder in the load chamber 3520. In such examples, the load chamber may have very thin walls (e.g., 0.05 mm to about 1.0 mm, as discussed herein).

Figure 8E:
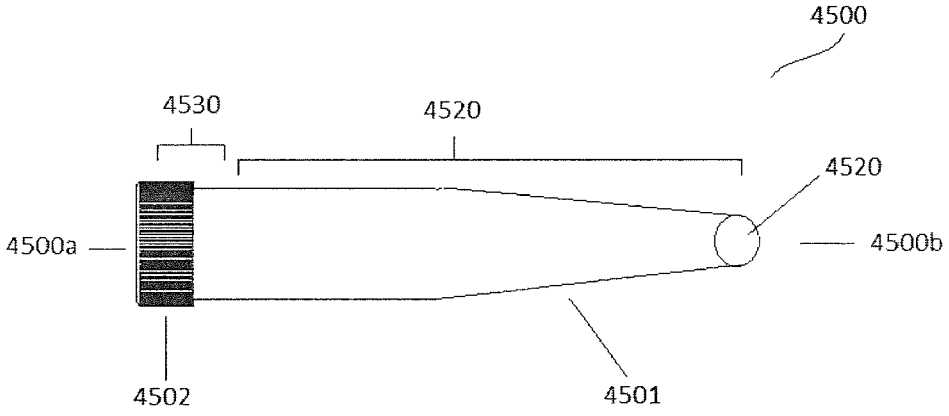
FIG. 8*e* provides a side view of a speed-loading device according to an embodiment of the present invention.

In other embodiments, the speed-loading device may have a tapered body that may be inserted into a complementary receiver in a black powder firearm. FIG. 8*e* shows an exemplary speed-loader 4500 that includes a head portion 4502 at its proximal end 4500*a* and a tapered body 4501 that has tapering outer diameter along its all or nearly all of its length. The load chamber 4520 may occupy nearly all of the length of the cylindrical body 4501 and may have a uniform inner diameter. There may be a short transfer channel 4530 near the head portion 4502. The speed-loading device 4500 may be positioned directly into the barrel at the breech of a break-action firearm or into a chamber of a revolving cylinder magazine of a revolver firearm such that the entire length or substantially all of the length of the body 4501 is positioned within the barrel or chamber. The barrel or chamber of the firearm includes a complementarily shaped receiving portion for receiving the speed-loading device 4500. In such examples, the strong walls of the barrel or chamber reinforce the distal end of the wall of the body 4501 against pressure created by the ignition of the black powder in the load chamber 4520.

Figure 9:
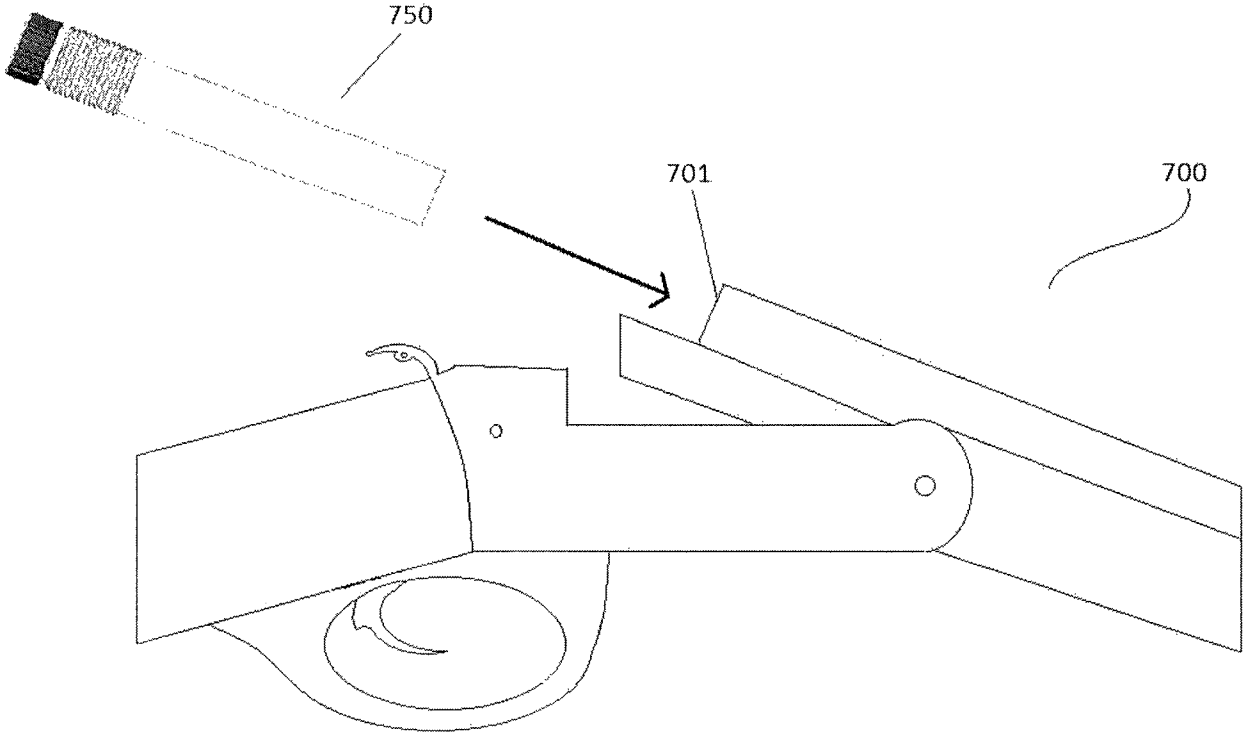
FIG. 9 provides a side view of a speed-loading device according to an embodiment of the present invention being inserted into the breech of a break-action firearm.

FIG. 9 provides a view of the insertion of a speed-loading device 750 into the breech 701 of a break-action black powder rifle 700. Once the break-action is opened, the breech 701 is exposed and the speed-loading device 750 may be inserted into the breech 701. As shown, e.g., in FIGS. 1-4 and 7, the speed-loading device 750 may have external threading that may engage with female threading within the breech 701. However, the external threading is not required. It is to be understood that a speed-loading device having no external threading (e.g., like speed-loading device 200) may be inserted into the breech of a break-action firearm, and properly function. The speed-loading device 750 may be quickly and easily removed from the breech 701 after the weapon is fired, and the speed-loading device 750 may be reloaded and reinserted breech 701, or a second pre-loaded speed-loading device may be inserted into the breech 701 to quickly reload the firearm 700. In some examples, and without limitation, the break-action black powder rifle 700 may be a modified firearm for receiving a speed-loading device of the present invention. For example, and without limitation, the breech of the firearm 700 may include an additional recess for receiving the load chamber, where the additional recess has a complementary shape to that of the exterior of the load chamber and the load chamber closely abuts the proximal end of the barrel when the speed-loading device is fully inserted into the firearm.

Figure 10:
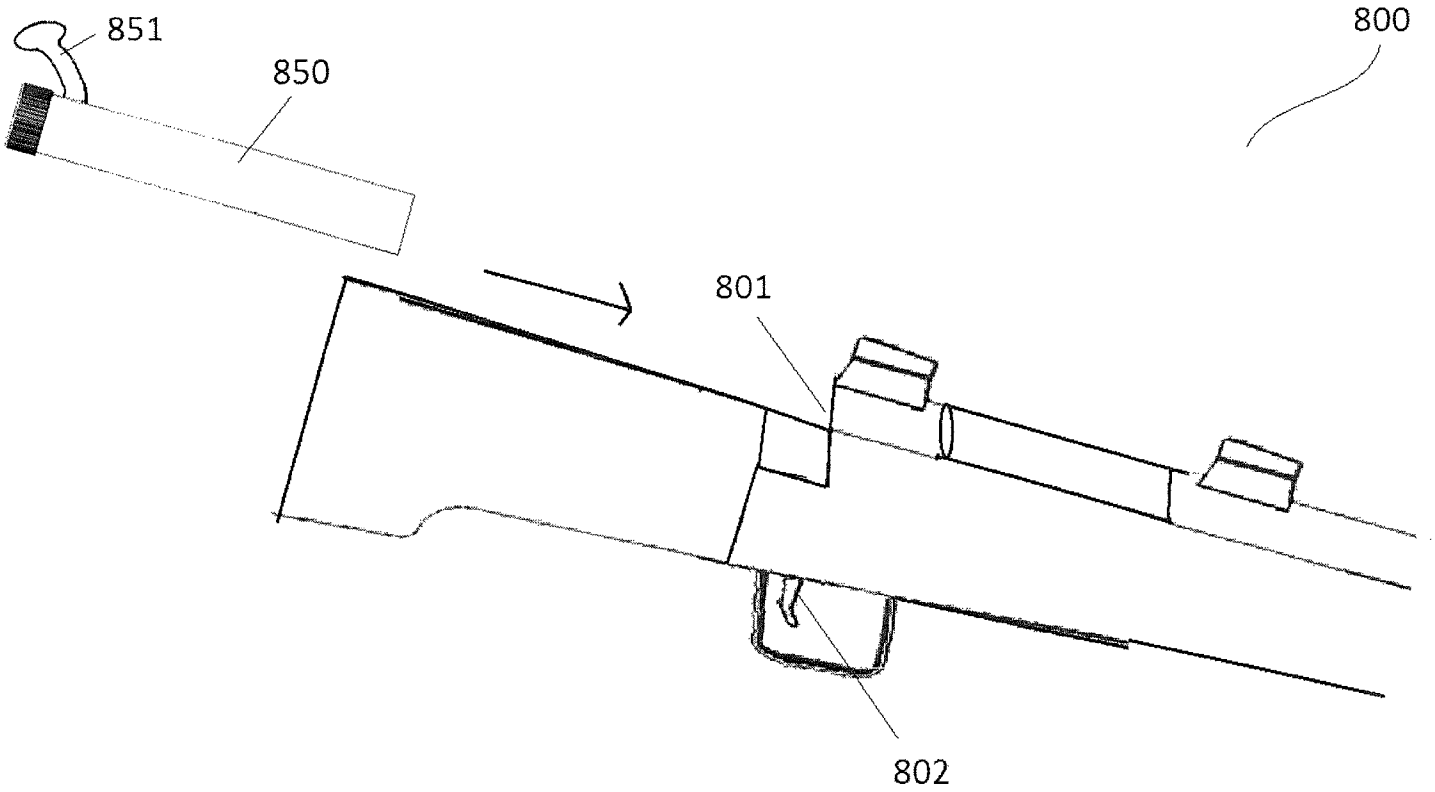
FIG. 10 provides a side view of a speed-loading device according to an embodiment of the present invention being inserted into the breech of a bolt-action firearm.

FIG. 10 provides a view of the insertion of a speed-loading device 850 into the bolt receiver 801 of a bolt-action black powder rifle 800. The speed-loading device 850 may be inserted into the bolt receiver 801 and locked into position by rotating the bolt arm 851 into the bolt arm slot 802. The speed-loading device 850 may be quickly and easily removed from the bolt receiver 801 after the weapon is fired, and the speed-loading device may be reloaded and reinserted into the bolt receiver 801, or a second pre-loaded speed-loading device may be inserted into the bolt receiver 801 to quickly reload the firearm 800. In some examples, and without limitation, the bolt-action black powder rifle 800 may be a modified firearm for receiving a speed-loading device of the present invention. For example, and without limitation, the breech of the firearm 800 may include an additional recess for receiving the load chamber, where the additional recess has a complementary shape to that of the exterior of the load chamber and the load chamber closely abuts the proximal end of the barrel when the speed-loading device is fully inserted into the firearm.

The present invention further includes embodiments of firearms that include a revolving cylinder configured to receive speed-loading devices as described herein. In such embodiments, and without limitation, a revolver firearm may include a revolving cylinder that includes two to ten parallel chambers (e.g., three to five chambers, or any value therein), each for receiving a speed-loading device. In such embodiments, and without limitation, the cylinder may be cycled (rotated) between chambers as the hammer of the firearm is pulled back into firing position. Implementations of the revolver may be single action or double action. Such embodiments may allow the operator of the firearm to shoot multiple shots without the need to reload.

Figure 11:
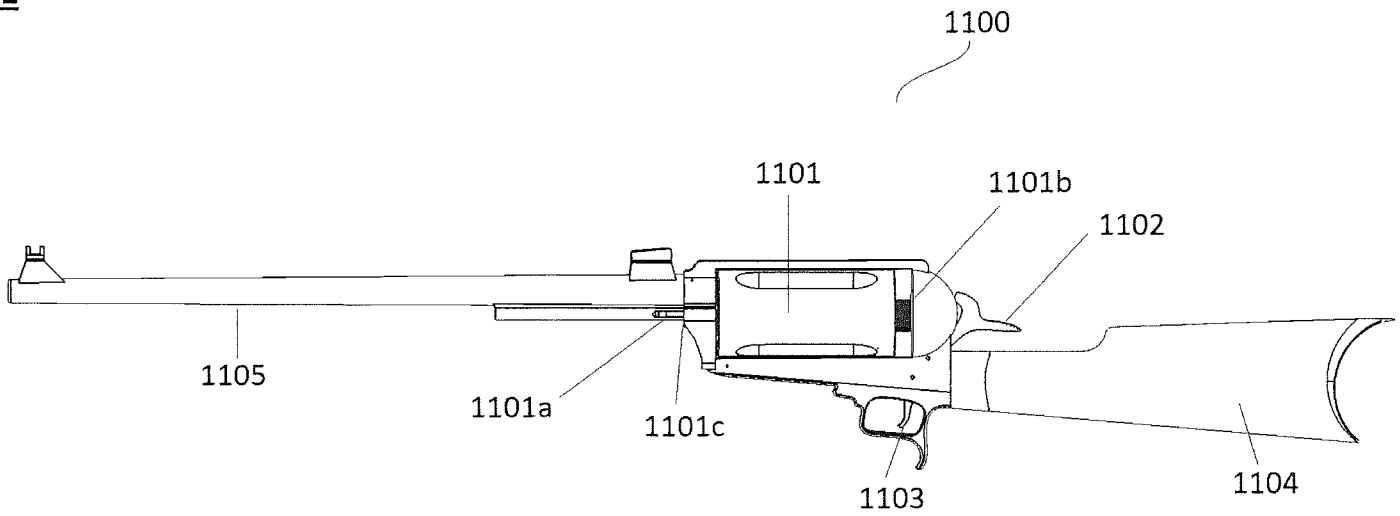
FIG. 11 provides a side view of a firearm having a revolving cylinder magazine according to an embodiment of the present invention.
Figure 12:
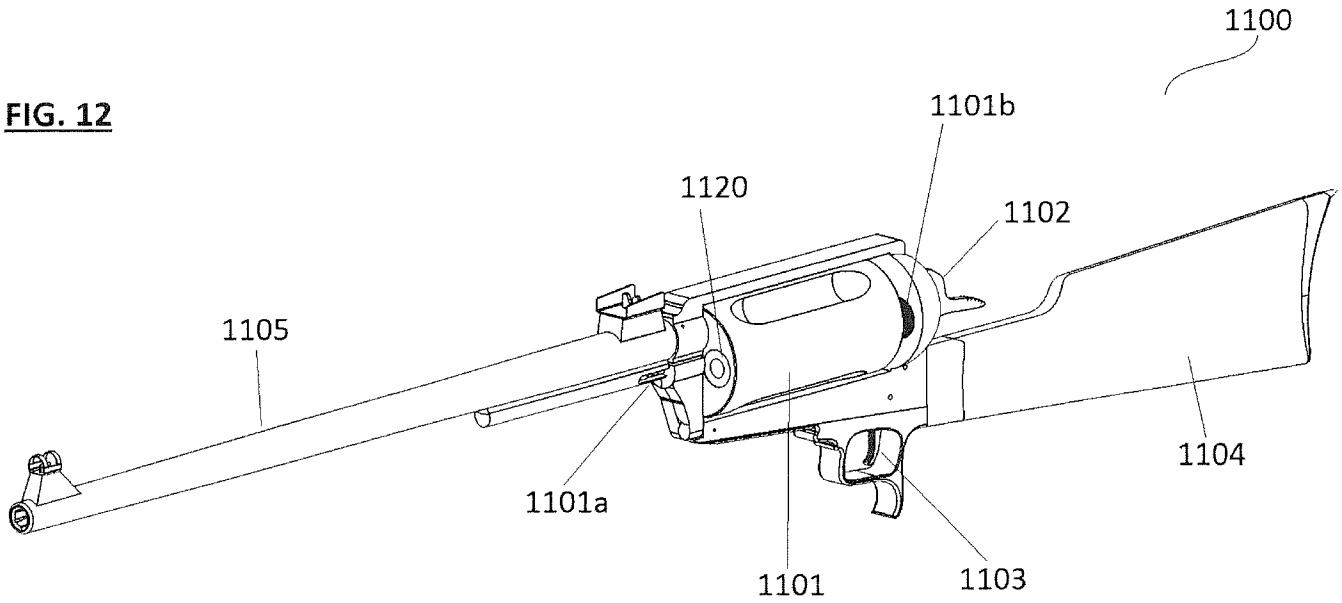
FIG. 12 provides a distal perspective view of a firearm having a revolving cylinder magazine according to an embodiment of the present invention.
Figure 13:
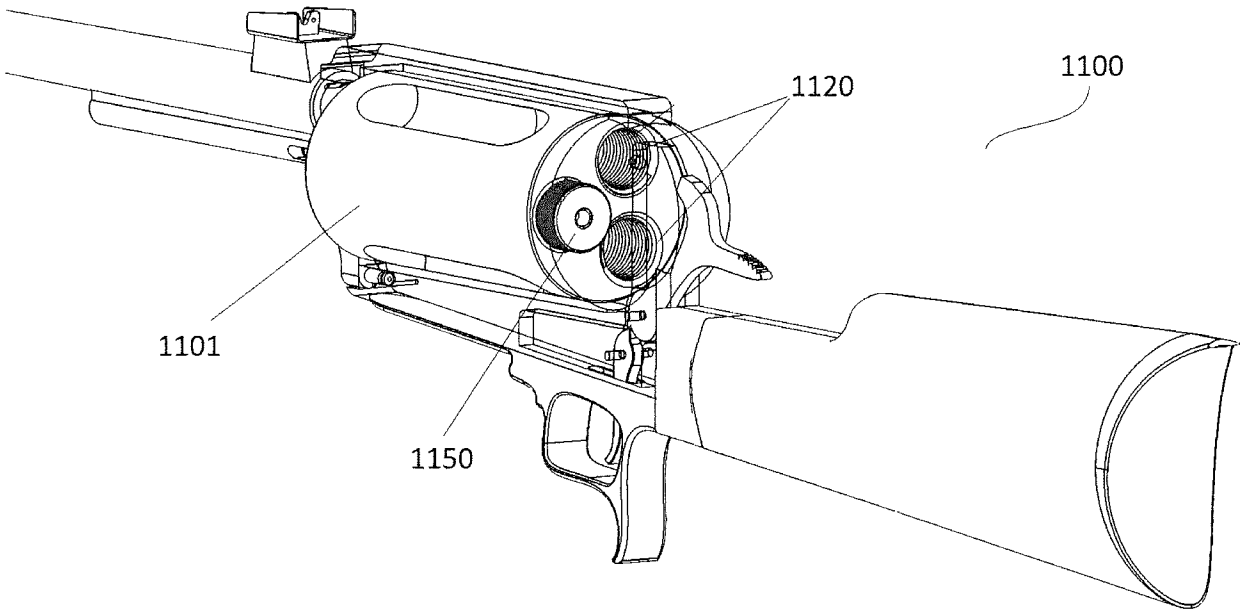
FIG. 13 provides a proximal perspective view of a firearm having a revolving cylinder magazine according to an embodiment of the present invention, with a speed-loading device according to the present invention inserted in a chamber of the cylindrical magazine.

Without limiting the invention, FIGS. 11-13 show an exemplary revolver firearm 1100, having a revolving cylinder 1101 for receiving speed-loading devices as described herein. The firearm 1100 may additionally include a hammer assembly 1102, a trigger assembly 1103, a stock 1104, a barrel 1105, and additional elements. The cylinder 1101 may include three chambers 1110 for receiving speed-loading devices 1150. However, the present invention is not limited to implementations that include three chambers. The firearm 1100 may also include a removable cylinder pin 1101*a* that holds the cylinder 1101 in position within the cylinder slot in the firearm, and a cycling mechanism 1101*b*.

FIG. 13 shows a posterior perspective view of the firearm 1100 with the posterior face of the cylinder exposed, and showing a speed-loading device 1150 positioned in one of the chambers 1120. It can be seen that the chambers 1120 include female threading for receiving male threading on the exterior of the speed-loading devices as discussed herein. In other implementations, and without limitation, the chambers 1120 may have a smooth bore for receiving speed-loading devices that have a smooth exterior surface with no threading, as discussed herein. In such implementations, the firearm 1100 may include an ejector for pushing the emptied speed-loading devices from the chambers after the loads in the speed-loading devices have been fired. Without limiting the other embodiments and implementations of the invention, when inserted into a chamber 1120, a speed-loading device 1150 may be cycled into firing position by the cycling mechanism 1101*b*, such that (1) the bore of the load chamber is concentrically aligned with the barrel 1105, (2) the primer pocket is aligned with the firing pin of the firearm (not shown), and (3) the distal end of the load chamber of the speed-loading device 1150 may closely abut the proximal end of the barrel 1105, such that the pressure created by the ignition of the black powder in the load chamber is efficiently transferred into the barrel 1105. Once the load of a speed-loading device 1150 has been fired, the next chamber 1120 may be cycled into firing position.

The cylinder 1101 may be removable for cleaning or replacement purposes. The cylinder may include an axial cylinder-pin-receiving hole for receiving the cylinder pin 1101*a* when the firearm 1100 is assembled. To assemble the firearm 1100 with the cylinder 1101 properly mounted in the cylinder slot of the firearm 1100, cylinder pin 1101*a* slides into a pin hole 1101*c* that is anterior to the cylinder slot, through the cylinder-pin-receiving hole of the cylinder, and into a locking recess in the center of the cycling mechanism 1101*b*. Without limiting the invention, the cylinder pin 1101*a* may suspend the cylinder 1101 in the cylinder slot, such that it may only contact the cylinder pin 1101*a*, the cycling mechanism 1101*b*, and the proximal end of the barrel 1105. To remove the cylinder 1101, the cylinder pin 1101*a* can be quickly extracted from the cylinder 1101 and the pin slot 1101*c* (e.g., the end of the cylinder pin 1101*a* may be engaged with the cycling mechanism by pressure fitting, reversible latch, etc.).

The cycling mechanism 1101*b* may include a mechanical pawl (not shown) that engages with the cylinder 1101, which may have notches thereon (e.g., on the proximal face of the cylinder, between the chambers, not shown) for receiving the pawl. The pawl may engage with a notch as the hammer 1102 is cocked in order to cycle the revolver (e.g., clockwise or counterclockwise) and position the next chamber in firing position in which it is aligned with the barrel 1105. The mechanical cycling of the revolver allows the operator of the firearm 1100 to quickly cycle through the loads in the speed-loading devices positioned in the chamber in a rapid and sequential fashion. Once the operator has fired the three loads, the cylinder may be removed to be reloaded.

In other embodiments, and without limitation, the cylinder may be a pivotally-attached swing-out cylinder that does not require the removal of the cylinder from the firearm, but rather the cylinder may be simply pivoted on a rotating pivot joint such that it is exposed at the side of the cylinder slot. In further embodiments, and without limitation, the firearm may be a break-top revolving firearm that allows for reloading of the cylinder without removal or pivoting of the cylinder. In still further embodiments, and without limitation, the firearm may have a loading gate that allows access to the chambers without the need to remove or pivot the cylinder, or break open the firearm.

The present invention provides speed-loading devices for black powder firearms, firearms adapted to receive speed-loading devices, and methods of using the same. It is to be understood that here are several variations in the speed-loading devices that provide additional benefits, as disclosed above. It should also be understood that the foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, and to thereby enable others skilled in the art to best utilize the invention and various embodiments with various modifications as are suited to the particular use contemplated.

What is claimed:

1. A breech loading device for use in a black powder firearm, comprising:

a. a cylindrical body having an open distal end and a proximal end, wherein the distal end is operable to be inserted into a firearm in alignment with a barrel of said black powder firearm;

b. a load chamber in the distal end of said breech-loading device having a bore therein of a diameter that is substantially the same as a barrel bore of said barrel of said black powder firearm, wherein said load chamber has a sufficient size to hold a firing load including a powder charge, a bullet, and a sabot; and c. a channel connecting said load chamber and said proximal end of said device, wherein said channel is operable to transmit a spark generated from a primer ignited by the firing operation of said black powder firearm, wherein a user pre-loads said breech loading device with said firing load before said breech loading device is inserted into the black powder firearm and said firing load is discharged through said open distal end during the firing operation of said black powder firearm.

2. The device of claim 1, wherein said breech loading device is operable to be loaded into the breech of a break-action muzzle-loading black powder firearm, wherein said black powder firearm can fire said firing load without the insertion of any propellant or projectile through the distal end of the barrel.

3. The device of claim 1, wherein said breech loading device is operable to be loaded into the bolt receiver of a bolt-action black powder firearm, wherein said black powder firearm can fire said firing load without the insertion of any propellant or projectile through the distal end of the barrel.

4. The device of claim 3, further comprising a bolt handle on said proximal end of said cylindrical body for manipulating said device within the bolt receiver and for engaging a bolt handle slot of said black powder firearm.

5. The device of claim 1, further comprising a primer pocket at said proximal end of said device, wherein said channel connects said primer pocket with said load chamber allowing a spark generated by a firing hammer of said black powder firearm striking a primer cap positioned in said primer pocket to travel to said load chamber and ignite gun powder positioned in said load chamber.

6. The device of claim 1, wherein said breech loading device is operable to be removed from said black powder firearm without the use of tools thereby enabling said user to remove said breech loading device from said black powder firearm after said firing load is discharged from the black powder firearm by hand.

7. The device of claim 1, wherein the exterior surface of said cylindrical body is smooth and has a uniform outer diameter to prevent obstruction of said device as it is inserted and removed from a breech of said black powder firearm, and a thickness of the wall of said cylindrical body around the load chamber is in a range of about 0.05 mm to about 1 mm.

8. The device of claim 1, further comprising a head portion adjacent to said proximal end of said cylindrical body for abutting a proximal end of a breech of said black powder firearm.

9. The device of claim 1, wherein said load chamber is detachable from the proximal end of the device.

10. A speed-loading device for use in a black powder firearm, comprising:

a. a cylindrical body having an open distal end and a proximal end, wherein the distal end is operable to be inserted into a receiver in said black powder firearm; and b. a bore in said cylindrical body, said bore having a uniform diameter that has substantially the same diameter as a bore of a barrel of the black powder firearm, wherein said bore is configured to be loaded with a firing load including a powder charge, a bullet, and a sabot such that said open distal end remains open after said bore is loaded, and said speed-loading device is pre-loaded with said firing load prior to insertion into said receiver.

11. The device of claim 10, wherein said black powder firearm is a break-action black powder firearm, and said receiver is a cavity at the breech of the break-action black powder firearm proximal to the barrel and said speed-loading device is operable to be inserted into said cavity at the breech of said break-action black powder firearm.

12. The device of claim 11, wherein said cavity is aligned with said barrel and said speed-loading device is inserted into said receiver in alignment with a barrel of said black powder firearm.

13. The device of claim 10, wherein said black powder firearm is a bolt-action black powder firearm, and said receiver is a bolt receiver of the bolt-action black powder firearm located proximal to the barrel and said speed-loading device is operable to be inserted into the bolt receiver after said speed-loading device is pre-loaded.

14. The device of claim 13, further comprising a bolt handle on said proximal end of said cylindrical body for manipulating said device within the bolt receiver and for engaging a bolt handle slot of said bolt-action black powder firearm.

15. The device of claim 10, wherein said speed loading device is operable to be removed from said receiver without the use of tools thereby enabling a user to remove said speed loading device from said receiver after said firing load is discharged from the black powder firearm by hand.

16. The device of claim 10, further comprising a head portion adjacent to said proximal end of said cylindrical body for abutting a proximal end of a breech of said black powder firearm.

17. The device of claim 10, wherein the exterior surface of said cylindrical body is smooth and has a uniform outer diameter to prevent obstruction of said device as it is inserted and removed from a breech of said black powder firearm, and a thickness of the wall of said cylindrical body around the bore is in a range of about 0.05 mm to about 1 mm.

18. The device of claim 10, wherein said load chamber is detachable from the proximal end of the device.

19. A black powder firearm, comprising:

a. a receiver for receiving a speed-loading device; and b. a speed-loading device comprising i. a cylindrical body having an open distal end and a proximal end, wherein the distal end is operable to be inserted into a receiver in said black powder firearm; and ii. a bore in said cylindrical body, said bore being coaxial with said cylindrical body and having a uniform diameter that has substantially the same diameter as a bore of a barrel of said black powder firearm, and is configured to be loaded with a firing load including a powder charge, a bullet, and a sabot prior to insertion into said receiver such that said open distal end remains open after said bore is loaded, wherein a user pre-loads said speed-loading device with said firing load before said speed-loading device is inserted into said receiver.

20. The black powder firearm of claim 19, wherein said black powder firearm comprises a revolving cylinder magazine, said receiver being one of a plurality of chambers in said revolving cylinder, each operable to receive said speed-loading device.

21. The black powder firearm of claim 19, wherein said black powder firearm is a break-action black powder firearm, and said receiver is a cavity at the breech of said break-action black powder firearm proximal to the barrel and said speed-loading device is operable to be inserted into said cavity of said break-action black powder firearm.

22. The black powder firearm of claim 21, wherein said cavity is aligned with said barrel and said speed-loading device is inserted into said cavity in alignment with said barrel of said break-action black powder firearm.

23. The black powder firearm of claim 19, wherein said black powder firearm is a bolt-action black powder firearm, and said receiver is a bolt receiver of said bolt-action black powder firearm proximal to the barrel and said speed-loading device is operable to be inserted into the bolt receiver.

24. The black powder firearm of claim 23, wherein said speed-loading device includes a bolt handle on said proximal end of said cylindrical body for manipulating said speed-loading device within the bolt receiver and for engaging a bolt handle slot of said bolt-action black powder firearm.

25. The black powder firearm of claim 19, wherein said speed-loading device is operable to be removed from said receiver without the use of tools thereby enabling said user to remove said breech loading device from said receiver after said firing load is discharged from the black powder firearm by hand.

26. The black powder firearm of claim 19, wherein the exterior surface of said cylindrical body is smooth and has a uniform outer diameter to prevent obstruction of said device as it is inserted and removed from the receiver of said black powder firearm, and a thickness of the wall of said cylindrical body around the bore is in a range of about 0.05 mm to about 1 mm.

27. The black powder firearm of claim 19, further comprising a head portion adjacent to said proximal end of said cylindrical body for abutting a proximal end of the receiver of said black powder firearm.

28. A method of loading a black powder firearm, comprising:

a. pre-loading propellant and a projectile into a speed-loading device comprising i. a cylindrical body having a distal end and a proximal end, wherein the distal end is operable to be inserted into a receiver in said black powder firearm, and ii. a load chamber having a bore, said bore having (1) a uniform diameter that has substantially the same diameter as a barrel bore of a barrel of the black powder firearm and (2) an open distal end, wherein said propellant and said projectile are packed into said load chamber and said open distal end of said bore remains open after said propellant and charge are pre-loaded into said load chamber; and b. inserting said speed-loading device into said receiver in said black powder firearm after said speed-loading device is pre-loaded with said propellant and said projectile.

29. The method of claim 28, wherein said speed-loading device includes a channel connecting said load chamber and said proximal end of said device, wherein said channel is operable to transmit a spark generated from a primer ignited by the firing operation of said black powder firearm, and said speed-loading device includes a primer pocket at said proximal end of said device, wherein said channel connects said primer pocket with said load chamber allowing a spark generated by a firing hammer of said black powder firearm striking a primer positioned in said primer pocket to travel to said load chamber and ignite gun powder positioned in said load chamber.

30. The method of claim 29, further comprising removing said speed-loading device from said black powder firearm after said propellant has been ignited and said projectile has been fired from said black powder firearm, wherein no additional propellant or projectile is loaded into said black powder firearm prior to removing said speed-loading device.

* * * * *